United States Patent [19]

Thurber

[11] Patent Number: 4,783,924

[45] Date of Patent: Nov. 15, 1988

[54] HANDGUN SAFETY DEVICE

[75] Inventor: Warren R. Thurber, Westlake Village, Calif.

[73] Assignee: Firelock, Inc., Golden, Colo.

[21] Appl. No.: 14,369

[22] Filed: Feb. 13, 1987

[51] Int. Cl.[4] ..... F41C 17/08

[52] U.S. Cl. ..... 42/70.11; 42/95

[58] Field of Search ..... 42/70.11, 95, 96

[56] References Cited

U.S. PATENT DOCUMENTS

| | | | |
|---|---|---|---|
| 1,665,257 | 4/1928 | Dade | 42/95 |
| 2,327,334 | 8/1943 | Parker | 42/70.11 |
| 2,479,107 | 8/1949 | Garretson | 42/70.11 |
| 2,763,081 | 9/1956 | Huckabee | 42/70.11 |
| 3,022,598 | 2/1962 | Wikstrom | 42/70.11 |
| 3,137,957 | 6/1964 | Ingalls | 42/70.11 |
| 3,360,880 | 1/1968 | Finnegan | 42/70.11 |
| 4,398,366 | 8/1983 | Wernicki | 42/70.11 |
| 4,412,397 | 11/1983 | Bayn | 42/70.11 |
| 4,569,144 | 2/1986 | Thurber | 42/70.11 |

*Primary Examiner*—Charles T. Jordan
*Assistant Examiner*—Michael J. Carone
*Attorney, Agent, or Firm*—Blakely, Sokoloff, Taylor & Zafman

[57] ABSTRACT

An improved firing safety device for handguns is disclosed. The device prevents the accidental discharge of a gun by children, but is easily removable by an adult thereby allowing the gun to be safely stored in a loaded and fully assembled condition. The gun may thus be readied for use almost immediately. The device includes a cartridge which is inserted into the firing chamber and a rod which is inserted into the gun barrel. The end of the rod is captured by and locked within the cartridge thereby preventing the gun cylinder from revolving. The device is removeable by applying manual pressure to a cap at the front of the rod which releases the capture mechanism within the cartridge and allows the rod to be withdrawn from the gun barrel.

13 Claims, 4 Drawing Sheets

HANDGUN SAFETY DEVICE

BACKGROUND OF THE INVENTION

1. Field of the Invention

The present invention relates to the field of safety device for handguns, and more particularly to devices for the prevention of accidental discharge of handguns.

2. Prior Art

The unintentional discharge of a handgun has been a source of needless injury for many years. Children playing with guns found in the home have been injured or killed at an alarming rate due to accidential firings. Numerous procedures and devices have been suggested to render a firearm "safe" or inoperative in order to prevent accidental firings. In most cases, attempts to prevent accidental dischage require that the firearm be disassembled or maintained in an unloaded condition. Accordingly, the firearm must be reassembled or loaded prior to use. Since most handguns are kept by owners for protection against emergency situations such as the entry of an intruder in the home, it is desirable that the firearm be rendered operable as quickly as possible.

U.S. Pat. No. 4,569,144, entitled "Handgun Safety Device", issued to this inventor discloses a quick release safety device for handguns, which permits a gun to be safely stored in a loaded and fully assembled condition. The device includes a rod which is inserted through the gun barrel and into the empty cartridge chamber. The rod is held in position by a cable which loops around the back of the gun. The device is removable by applying manual pressure to a cap at the front of the rod which depresses a spring and releases the tension on the cable. This device requires a suitable gripping point at the back of the gun and the exposed cable is subject to tampering.

As will be described, the present invention represents an improvement over the above-referenced patent, whereby the locking mechanism of the safety device is entirely within the gun.

SUMMARY OF THE INVENTION

The present invention is a firing safety device for handguns and is designed to prevent accidental discharge of a gun. The gun cannot be discharged with the safety device in position; however, the device can be removed quickly by application of manual pressure. The amount of pressure required to remove the device is greater than that which a child is physically capable of applying. A rod having a spindle at the end thereof is inserted into the barrel of the gun and a special cartridge is inserted in the firing chamber of the gun. The spindle penetrates the cartridge and is captured by traps molded on the inner surface of the cartridge. A rigid locking member thereby extends from the muzzle to the firing pin of the gun.

The rod is attached to a cap having a rubber bumper. The rod is inserted into the barrel of the gun and pressure is applied to the bumper, such as by pressing against a solid object. The cap encloses a muzzle spring which forces a muzzle stop against the muzzle of the gun. Pressure applied to the bumper compresses the muzzle spring and forces the rod and spindle into the barrel of the gun until the spindle engages the cartridge. The spindle and cartridge are heldin an engaged position by the force of the muzzle spring. To remove the device, pressure must again be applied to the bumper to compress the muzzle spring and release the spindle from the cartridge.

The invention thus provides a firing safety device to present the accidental discharge of the gun especially by children. Due to the amount of force required to compress the muzzle spring, the device cannot be removed by children under the age of approximately ten years. However, an adult can quickly remove the device to permit the gun to be fired in an emergency situation.

DETAILED DESCRIPTION OF THE INVENTION

The present invention is a safety device for handguns designed to prevent accidental discharges, especially by children. In the following description, for purposes of explanation, specific materials and configurations are set forth in order to provide a thorough understanding of the present invention. However, it will be apparent to one skilled in the art that the present invention may be practiced without these specific details.

Figure 1:
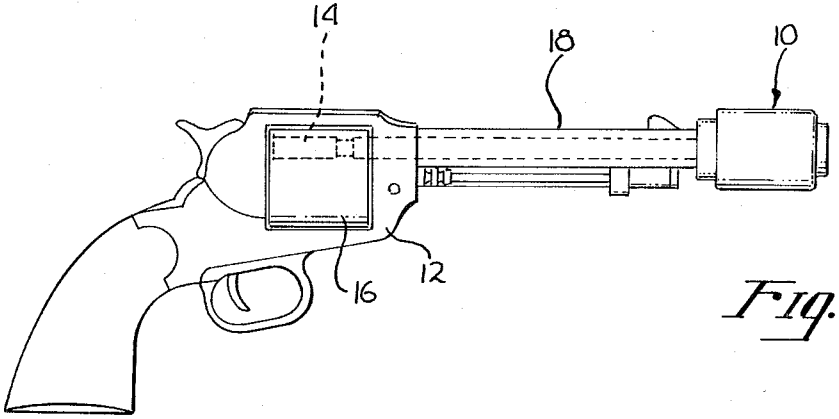
FIG. 1 is a side view of a handgun showing the locking device and cartridge (in ghost lines) of the present invention in place.

Referring to FIG. 1, the present invention includes a locking device 10 which is inserted into the barrel 18 of a handgun 12 and a cartridge 14 which is inserted into cylinder 16. Although a revolver is illustrated in FIG. 1, the present invention may also be used with other types of handguns, such as semi-automatics and automatics.

Figure 2:
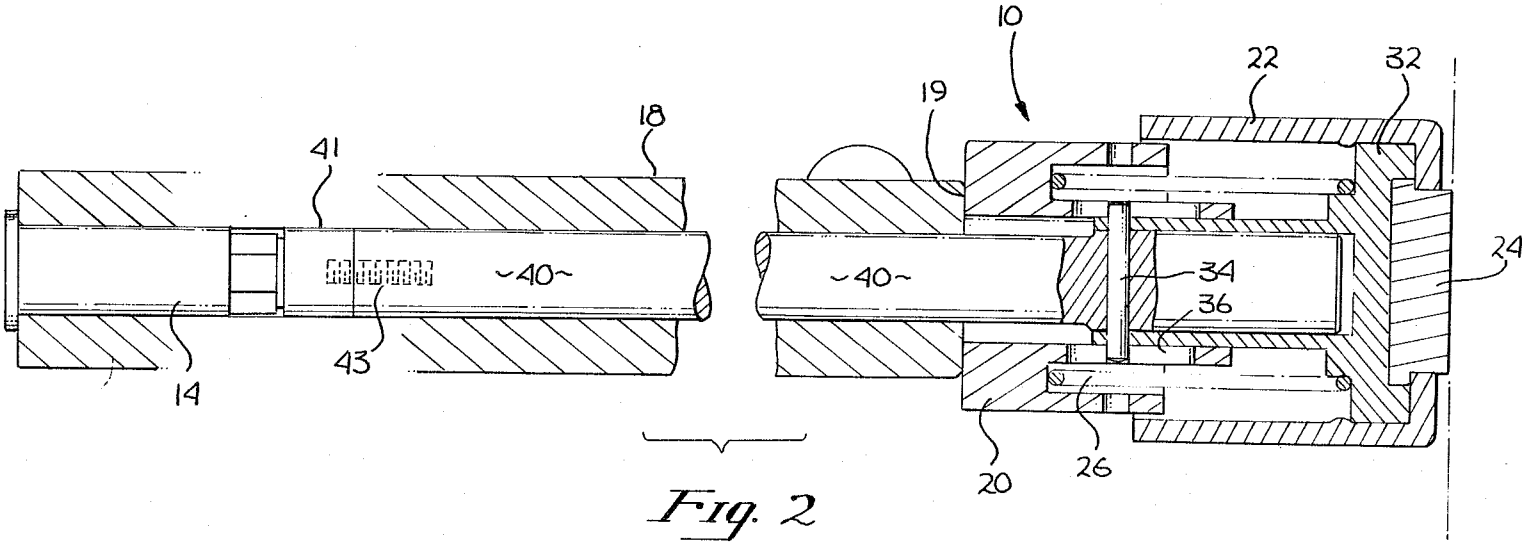
FIG. 2 is a partial enlarged cross-sectional view of FIG. 1.

FIG. 2 illustrates locking device 10 inserted into barrel 18 and capturing cartridge 14. Locking device 10 is gripped by cap 22 to insert rod 40 into barrel 18. Bumper 24, which is preferably made of a resilient rubber-like material, is placed against a solid surface, such as a wall or floor, and pressure is applied to gun 12 forcing muzzle 19 against muzzle stop 20. Muzzle stop 20 telescopes over endpiece 32 and is retained by pin 34 riding in slot 36. Muzzle stop 20 and endpiece 32 are biased apart by muzzle spring 26. Further pressure on bumper 24 causes muzzle spring 26 to compress. Bumper 24 bears against endpiece 32 forcing rod 40 to penetrate further into barrel 18 until rod 41 penetrates cartridge 14 and is captured therewithin. Details of cartridge 14 and rod end 41 which facilitate the capture of locking device 10 within cartridge 14 will be described below. With locking device 10 thus secured, operation of gun 12 is totally disabled. Cap 22 is free to rotate about endpiece 32 thereby rendering secured locking device 10 to tamper resistant.

Locking device 10 is removed from gun 12 by again applying pressure against bumper 24. Further compression of muzzle spring 26 causes rod end 41 to penetrate further into cartridge 14 and be released. Locking device 10 may then be withdrawn from barrel 18. Muzzle spring 26 is sized such that a minimum of 40 pounds of pressure is required to release locking device 10, thereby preventing its removal by children under the age of approximately ten years.

Figure 3:
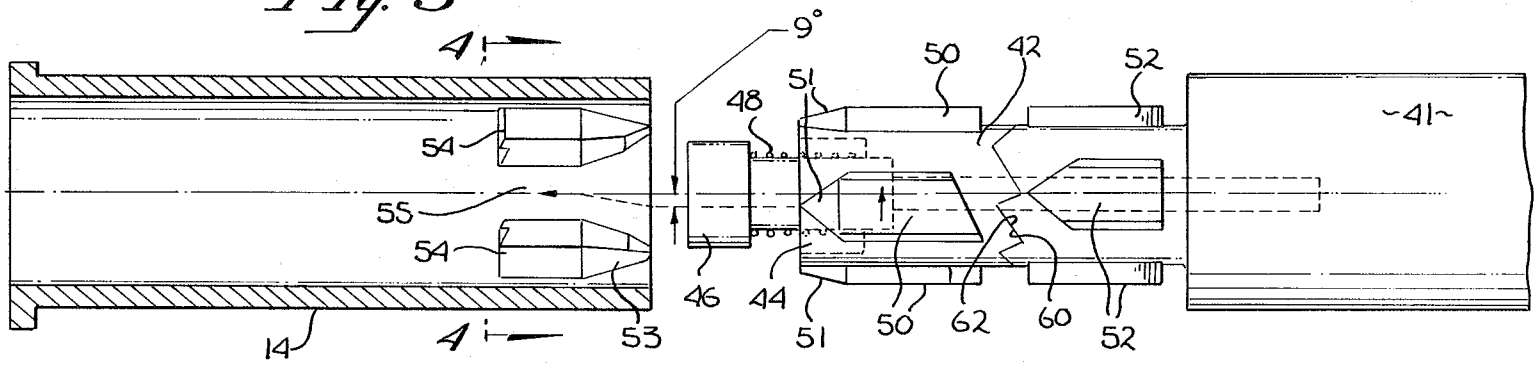
FIG. 3 illustrates the cartridge and locking device of the present invention as they are brought into engagement.
Figure 4:
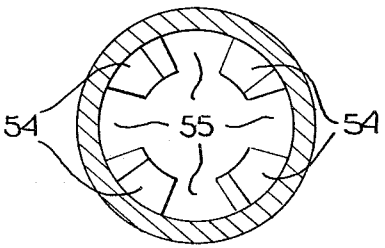
FIG. 4 is a cross section through line 4—4 of FIG. 3.

Referring now to FIGS. 3–10, the detailed operation of the locking mechanism will be explained. As best shown in FIGS. 3 and 4, cartridge 14 comprises a flanged hollow cylinder which fits within cylinder 16. Four traps 54 are molded on the interior surface of cartridge 14 near the end opposite the flanged end. Traps 54 are disposed at 90° intervals about the interior circumference of cartridge 14. Cartridge 14 has the approximate dimensions of a shell casing which gun 12 is designed to fire and is preferably made of a high-strength moldable material such as ABS plastic.

The outer dimensions of spindle 42 and rod end 41 are such that they slide within the cylindrical inner surface of cartridge 14. Spindle 42 and rod end 41 are also preferably made of the same material as cartridge 14. Rod end 41 is secured to rod 40 by means of threaded stud 43 as shown in FIG. 2. Rod 40 may be of the same material as cartridge 14, spindle 42 and rod end 41 or may be made of a different material such as aluminum or steel. The length of rod 40 is determined by the barrel length of the gun such that rod end 41 may penetrate cartridge 14, as described below, upon compression of muzzle spring 26. Coarse adjustment of the length of rod 40 may be accomplished by attaching one or more segments joined by threaded studs such as stud 43. Fine adjustment of the length of rod 40 to account for variation in barrel lengths, such as exists between guns of different manufacturers, may be accomplished by partially unscrewing one of the rod segments or by means of a length adjustment (not shown) incorporated within one or more of the rod segments.

Spindle 42 is attached to rod end 41 by means of screw 46. Spindle 42 is urged against rod end 41 by spring 48 which bears against spindle 42 within recess 44. Mating surfaces 60 of rod end 41 and 62 of spindle 42 define a series of alternating ramped annular segments which repeat at 45° intervals about the circumference of rod end 41 and spindle 42. When locking device 10 is not in use, the pressure applied by spring 48 causes surfaces 60, 62 to be everywhere engaged as illustrated in FIG. 3. The travel of spindle 42 on screw 46 is sufficient to allow spindle 42 to be disengaged from rod end 41 so as to rotate freely thereabout but is limited to approximately one-half of the allowable travel of muzzle spring 26, thereby assuring that muzzle spring 26 is partially compressed when locking device 10 is secured within gun 12.

Dogs 50 are molded onto the external surface of spindle 42 and dogs 52 are molded onto the external surface of rod end 41. Dogs 50 and 52 are disposed at 90° intervals about the circumference of spindle 42 and rod end 41 respectively. With surfaces 60, 62 fully engaged, dogs 50 are radially offset from dogs 52 by approximately 9°. Although the invention is described in terms of four each of traps 54, dogs 50 and dogs 52, it is to be understood that other number of these elements may be employed within the teaching of this disclosure subject to corresponding adjustments of the relates angular dimensions.

Figure 10:
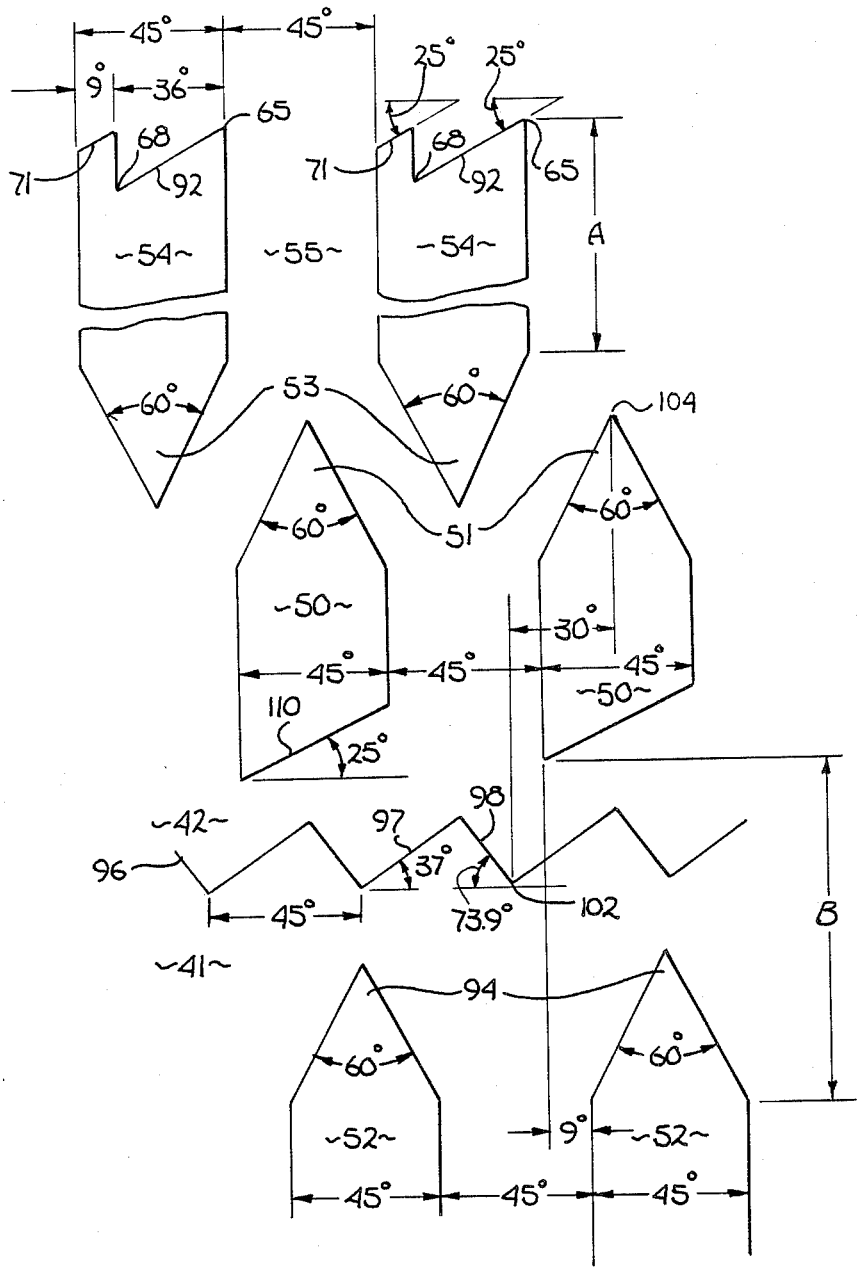
FIG. 10 is a schematic view of the cartridge and locking device of FIG. 3 illustrating certain dimensions thereof.

Particular dimensions of the described embodiment are schematically illustrated in FIG. 10. Traps 54 are each 45° in extent as are spaces 55 separating adjacent traps. Notches 68 are 36° from corners 65 so that the radial dimension of surface 71 if 9°. Surface 71 and surface 92 of traps 54 are inclined by 25° from a plane perpendicular to the axis of cartridge 14. Surface 110 of spindle dogs 50 is similarly inclined at an angle of 25°. Dogs 50 and 52 are all 45° in extent and separated from adjacent dogs by 45°. As described above, dogs 50 and 52 are radially offset by 9°. Tapered ends 51, 53 and 94 all have included angles of 60°.

Parting line 96, defining mating surface 60, 62 of rod end 41 and spindle 42 respectvely, comprises a series of ramps 97 repeating at 45° intervals and inclined at 37° to a plane perpendicular to the axis of rod 40 alternating with ramps 98 inclined at approximately 73.9°. Point 102 of line 96 is radially located 30° from tip 104 of spindle dog 50. In order to assure simultaneous alignement of dogs 50 and 52 in spaces 55 during insertion of locking device 10 into cartridge 14, dimension "A" of FIG. 10 must be greater than dimension "B" by at least an amount corresponding to the axial displacement of spindle 42 resulting from a 9° rotation with respect to rod end 41.

Figure 5:
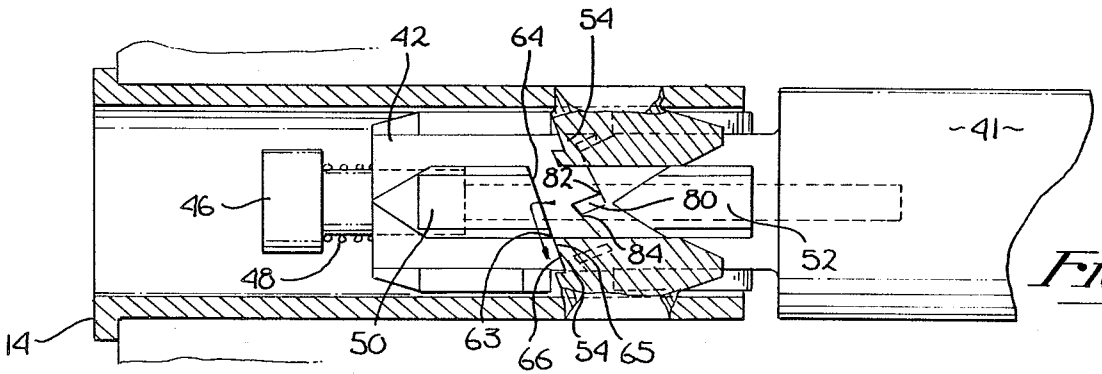
FIG. 5 illustrates the cartridge and locking device of FIG. 3 as the spindle penetrates the cartridge.

Referring now to FIG. 3, as rod 40 in inserted in barrel 18, tapered ends 51 of spindle dogs 50 contact tapered ends 53 of cartridge traps 54. As further pressure is applied, spindle 42 rotates such that dogs 50 are aligned with spaces 55 between cartridge traps 54. The path of dog 50 designated "A" in FIG. 3 as it penetrates cartridge 14 is shown generally by the dashed arrow. As spindle 42 rotates, ramped surface 62 of spindle 42 slides along ramped surface 60 of rod end 41, thereby creating gap 80 and partially compressing spring 48. With spindle dogs 50 aligned with spaces 55, rod 40 may be further inserted so that dogs 52 are received within spaces 55 as shown in FIG. 5. At this point, corner 63 of spindle dog 50 just clears corner 65 of cartridge trap 54. Pressure applied by compressed spring 48 causes surface 62 to slide with respect to surface 60, thereby closing gap 80 and causing spindle 42 to rotate in the direction shown by the arrow in FIG. 5. As spindle 42 thus rotates, ramped surface 64 of spindle dog 50 engages ramped surface 66 of cartridge trap 54.

Figure 6:
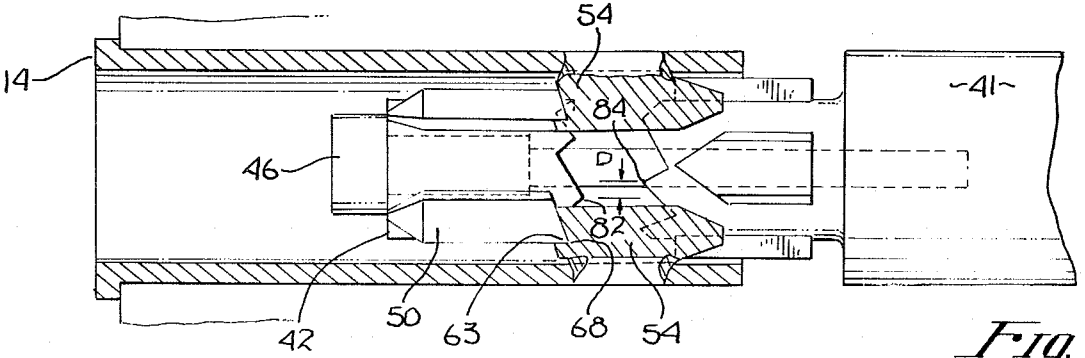
FIG. 6 illustrates the cartridge and locking device of FIG. 3 in a locked position.

The engagement of surfaces 64, 66 prevent spindle 42 from being withdrawn from cartridge 14. As pressure against bumper 24 is released, muzzle spring 26 forces rod 40 to withdraw. Spindle 42 continues to rotate until corner 63 of spindle dog 50 engages notch 68 of cartridge trap 54 as shown in FIG. 6. At this point, the engagement of spindle dog 50 and notch 68 prevent further rotation of spindle 42. The angles of ramped surfaces 60, 62 and the location of notch 68 on trap 50 as illustrated in FIG. 10 are so related that when spindle dog 50 rests within notch 68, spindle 42 has rotated through an angle sufficient to cause point 82 of surface 62 to rotate beyond point 84 of surface 60 as indicated by "D" in FIG. 6. Rod 40 is withdrawn by the relaxation of muzzle spring 26 until screw 46 seats against spindle 42. Locking device 10 is then firmly secured wtihin gun 12 by the remaining compression of muzzle spring 26.

Figure 7:
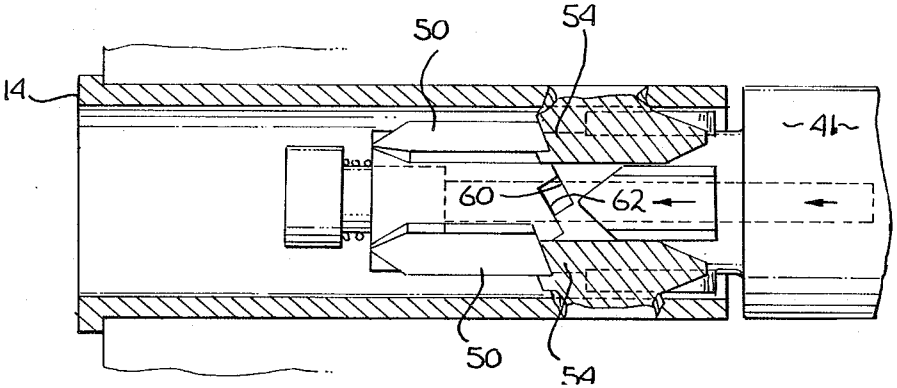
FIG. 7 illustrates the cartridge and locking device of FIG. 3 as they are being disengaged.
Figure 8:
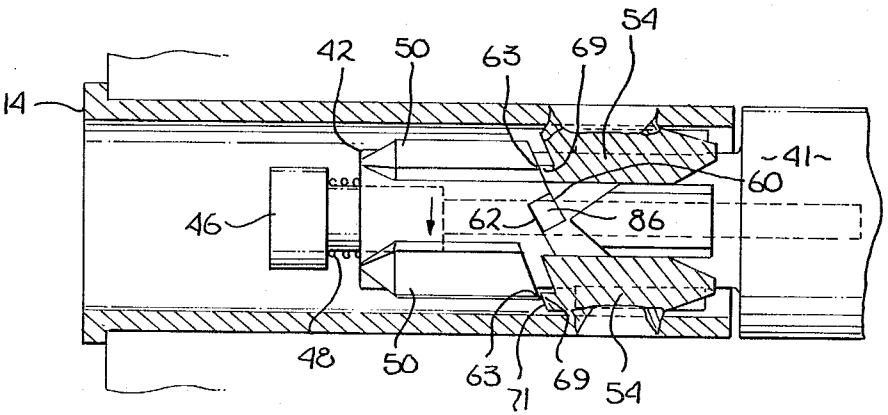
FIG. 8 illustrates the cartridge and locking device of FIG. 3 in a further stage of disengagement.

Locking device 10 is removed by again applying pressure against bumper 24 to compress muzzle spring 26 and force rod 40 further into barrel 18. Referring to FIG. 7, as rod 40 is forced in the direction shown by the arrows, ramped surface 60 of rod end 41 contacts ramped surface 62 of spindle 42. Spindle 42 is thereby forced further into cartridge 14 such that corner 63 of spindle dog 50 clears corner 69 of cartridge trap 54 as shown in FIG. 8. Pressure applied by spring 48 again causes surface 62 to slide with respect to surface 60, thereby closing gap 86 and causing spindle 42 to further rotate in the direction shown by the arrow in FIG. 8. Spindle 42 continues to rotate and move axially against rod end 41 until gap 86 is fully closed. At this point, surface 64 of spindle dog 50 will be in contact with surface 71 of trap 54. Continued withdrawal of rod 40 from the gun barrel due to the force of the muzzle spring will cause surface 60 of rod end 41 to separate from surface 62 of spindle 42 in an axial direction and will cause spring 48 to compress. Surface 64 of spindle dog 50 will slide with respect to surface 71 of trap 54, causing spindle 42 to further rotate in the direction of the arrow shown in FIG. 8.

Figure 9:
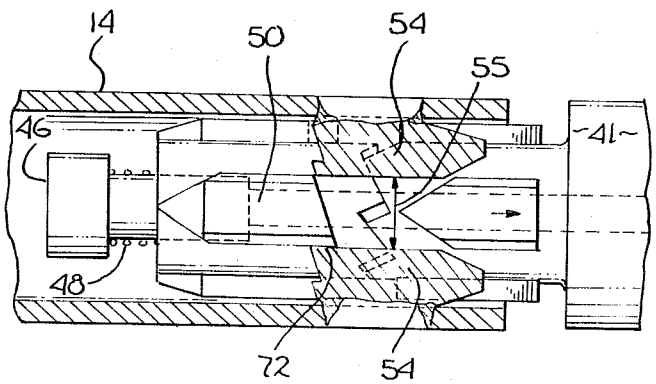
FIG. 9 illustrates the cartridge and locking device of FIG. 3 as the locking device is withdrawn from the gun.

Spindle 42 continues to rotate until spindle dog 50 strikes surfrace 72 of trap 54 as shown in FIG. 9. At this point, spindle dogs 50 are again aligned with spaces 55 in cartridge 14 such that locking device 10 may be withdrawn from gun barrel 18. It should be noted that spindle 42 as portrayed in FIG. 9 has rotated a full 90° from its position shown in FIG. 5.

When locking device 10 is withdrawn from barrel 18 of gun 12, gun 12 is in condition to be fired. In the case of a revolver, cylinder 16 may be rotated by the firing mechanism to a chamber containing a live round. In the case of an automatic, movement of the slide will eject cartridge 14 and permit a live round to enter the firing chamber.

Figure 11:
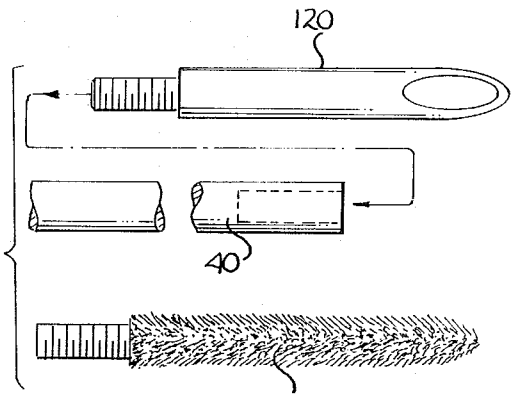
FIG. 11 illustrates gun cleaning attachments which may be used in conjunction with the present invention.

Locking device 10 may be adapted for use as a gun cleaning tool by use of attachments as shown in FIG. 11. Cloth holder 120 and bore brush 122 may be threaded onto rod 40 in place of rod end 41 when it is desired to periodically clean the gun.

While the present invention has been particularly described with reference to FIGS. 1–11, and with primary emphasis on handguns, it should be understood that the figures are for illustation only and not as a limitation upon the invention. It is contemplated that many changes and modifications may be made by one of ordinary skill in the art to the materials and arrangements of elements of the invention, without departing from the spirit and scope of the invention.

I claim:

1. A device for preventing the discharge of a firearm, said firearm having a barrel, a muzzle and a cartridge chamber, said device comprising:

a rod including an inner and an outer end, said rod insertable in the barrel through the muzzle with the outer end extending from the muzzle;

spring means coupled to the rod and disposed against the muzzle when the rod is inserted into the barrel for urging the rod to withdraw from the barrel;

a cartridge disposed in said cartridge chamber;

locking means coupled to the inner end of the rod for engaging the cartridge and locking thereto as said rod is inserted into the barrel such that said spring means is partially compressed;

a spindle disposed at said inner end of said rod said spindle coupled to said rod by retaining means such that the spindle may rotate with respect to the rod about a common longitudinal axis;

said spring means comprising:

a cap coupled to said outer end of said rod and freely rotatable thereabout, said cap including a bumper;

a muzzle stop disposed against said muzzle of said barrel when said rod is inserted into said barrel; and a muzzle spring disposed between and biasing apart said cap and said muzzle stop.

2. The device of claim 1 wherein said spindle includes a first dog having an anterior surface and disposed on the circumference of said spindle and said rod includes a second dog disposed on the circumference of said rod.

3. The device of claim 2 wherein said spindle and said rod each include a mating surface comprising a plurality of inclined annular segments, whereby rotation of the spindle with respect to the rod imparts a reciprocating motion to the spindle along the longitudinal axis thereof.

4. The device of claim 3 wherein said retaining means includes a spindle spring to urge said spindle against said rod at said mating surfaces.

5. The device of claim 4 wherein said first and second dogs are disposed such that said first and second dogs are not radially aligned when said mating surfaces are fully engaged.

6. The device of claim 5 wherein said cartridge includes an inner cylindrical surface having a plurality of traps disposed thereon and spaced apart such that said first and second dogs may pass therebetween.

7. The device of claim 6 wherein said traps include a notched posterior surface such that, when said spindle and said rod are inserted in said cartridge such that said second dog is inserted between said traps, said anterior surface of said first dog engages said notched posterior surface of one of said traps, whereby said spindle is prevented from being withdrawn from said cartridge.

8. The device of claim 7, wherein said inclined annular segments of said mating surfaces are disposed such that, when said anterior surface of said first dog is engaged with said notched posterior surface of one of said traps and said rod is inserted within said cartridge, said spindle is rotated such that said first dog may pass between said traps, thereby permitting the spindle to be withdrawn from said cartridge.

9. The device of claim 1 further comprising engagement means coupled to said locking means for causing said locking means to engage said cartridge as a first axial force is applied against said outer end of said rod.

10. The device of claim 9, further comprising disengagement means coupled to said locking means for causing said locking means to disengage said cartridge as a second axial force is applied against said outer end of said rod.

11. The device of claim 10 wherein said second axial force is greater than approximately forty pounds.

12. The device of claim 7, further comprising cleaning means threadably attached to said inner end of said rod for cleaning said barrel of said firearm.

13. The device of claim 1 wherein said rod comprises a plurality of longitudinal segments threadably attached one to another.

* * * * *